US005404216A

United States Patent [19]

Numagami et al.

[11] Patent Number: 5,404,216

[45] Date of Patent: Apr. 4, 1995

[54] CLEANING DEVICE, IMAGE FORMING APPARATUS INCLUDING THE CLEANING DEVICE, AND METHOD OF ASSEMBLING THE CLEANING DEVICE

[75] Inventors: Atsushi Numagami, Hadano; Tadayuki Tsuda, Kawasaki; Masahiko Yashiro, Yokohama, all of Japan

[73] Assignee: Csnon Kabushiki Kaisha, Tokyo, Japan

[21] Appl. No.: 942,213

[22] Filed: Sep. 9, 1992

[30] Foreign Application Priority Data

Sep. 12, 1991 [JP] Japan ..... 3-260583
Jul. 16, 1992 [JP] Japan ..... 4-189493

[51] Int. Cl.[6] ..... G03G 21/00

[52] U.S. Cl. ..... 355/296; 15/256.5; 355/299

[58] Field of Search ..... 355/297, 299, 296, 298; 15/256.5, 256.51, 256.53

[56] References Cited

U.S. PATENT DOCUMENTS

| | | | |
|---|---|---|---|
| Re. 30,924 | 5/1982 | Katayama et al. | 15/256.51 |
| 4,211,484 | 7/1980 | Iwai et al. | 15/256.51 X |
| 4,218,131 | 8/1980 | Ito et al. | 355/299 |
| 4,400,082 | 8/1983 | Kiba | 15/256.53 X |
| 4,498,760 | 2/1985 | Sugiyama | 355/299 |
| 4,802,928 | 2/1989 | Dunlap | 15/256.51 X |
| 4,806,981 | 2/1989 | Ishiguro et al. | 15/256.51 X |
| 4,870,449 | 9/1989 | Brown | 355/297 |
| 4,937,632 | 6/1990 | Kamidaira | 355/299 |
| 4,947,216 | 8/1990 | Surti | 355/299 |
| 5,021,830 | 6/1991 | Koiso | 355/298 |

FOREIGN PATENT DOCUMENTS

| | | |
|---|---|---|
| 59-34578 | 2/1984 | Japan . |
| 61-212881 | 9/1986 | Japan . |
| 1-185587 | 7/1989 | Japan . |
| 2-162388 | 6/1990 | Japan . |
| 4-294381 | 10/1992 | Japan . |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

A cleaning device for removing toner particles remaining on an image bearing member includes a cleaning blade for contacting the image bearing member and sealing members for contacting side edges of the cleaning blade. The side edges of the cleaning blade and/or edge portions of the sealing members contacting the side edges of the cleaning blade are tapered. An image forming apparatus for forming an image on a recording medium includes an image bearing member, the cleaning device and a conveying device for conveying the recording medium. A method of assembling the cleaning device includes the steps of providing the cleaning blade and the sealing members, and forming the side edges of the cleaning blade and/or the edge portions of the sealing members contacting the side edges of the cleaning blade in a tapered state, and contacting the side edges of the cleaning blade to the edges of the sealing members.

20 Claims, 8 Drawing Sheets

CLEANING DEVICE, IMAGE FORMING APPARATUS INCLUDING THE CLEANING DEVICE, AND METHOD OF ASSEMBLING THE CLEANING DEVICE

BACKGROUND OF THE INVENTION

1. Field of the Invention

This invention relates to a cleaning device, an image forming apparatus which includes the cleaning device, and a method of sealing the cleaning device. The image forming apparatus comprises, for example, an electrophotographic copier, a laser-beam printer, a facsimile apparatus, a word processor, and the like.

2. Description of the Related Art

In an image forming apparatus, which uses an electrophotographic technique, after a toner image formed on the surface of an image bearing member has been transferred onto a transfer material, such as paper or the like, toner particles which have not contributed to the transfer operation remaining on the surface of the image bearing member must be removed from the surface of the image bearing member. Cleaning blades made of elastic materials, such as rubber or the like, have been widely used as cleaning means for removing the remaining toner particles.

In a cleaning device having the above-described configuration, there is no particular problem at the end portions of an opening of a receptacle which accommodates the cleaning blade on the sides coinciding with the direction of the axis of the image bearing member, since the cleaning blade, a scooping sheet or the like is disposed. However, at a portion of the opening orthogonal to the axis of the image bearing member, a small gap must be provided between the end portion and the surface of the image bearing member. Accordingly, it is necessary to provide a sealing member for preventing leakage of toner particles from that portion.

In the above-described configuration, since the distance between the cleaning blade and its supporting member is constant, various kinds of errors, such as processing errors in the components, a dimensional error in the sealing member, an assembling error of the cleaning blade, an attachment error produced when the sealing member is attached, and the like, inevitably occur. Accordingly, it is practically impossible to completely bring the cleaning blade in close contact with the sealing member. Hence, it is difficult to reliably prevent leakage of toner particles from the gap between the sealing member and the surface of the image bearing member.

SUMMARY OF THE INVENTION

It is an object of the present invention to provide a cleaning device in which sealability is greatly improved, an image forming apparatus which includes the cleaning device, and a method of assembling the cleaning device.

It is another object of the present invention to provide a cleaning device whose ease of assembling is greatly improved so as to be suitable for mass production, an image forming apparatus which includes the cleaning device, and a method of assembling the cleaning device.

It is still another object of the present invention to provide a cleaning device in which tapered portions are provided in at least one of the side edges of the cleaning blade and sealing members facing it and the side edges of the cleaning blade and the sealing members are brought to be in close contact by being engaged with each other in a wedge-like manner, whereby leakage of toner particles is reliably prevented and the device is suitable for mass production, and also to provide an image forming apparatus which includes the cleaning device, and a method of assembling the cleaning device.

In order to accomplish the foregoing objectives, the invention in one aspect pertains to a cleaning device for removing toner particles remaining on an image bearing member, the device comprising a cleaning blade for contacting the image bearing member; and sealing members having edge portions for contacting side edges of the cleaning blade, wherein the side edges of the cleaning blade and/or the edge portions of the sealing members contacting the side edges of the cleaning blade are tapered.

The invention in another aspect pertains to an image forming apparatus for forming an image on a recording medium, the apparatus comprising a cleaning blade for contacting the image bearing member, and sealing members having edge portions for contacting the edges of the cleaning blade, the side edges of the cleaning blade and/or the edge portions of the sealing members contacting the side edges of the cleaning blade being tapered; and conveying means for conveying the recording medium.

The invention in yet another aspect pertains to a method of assembling a cleaning device for removing toner particles remaining on an image bearing member, the method comprising the steps of providing a cleaning blade for contacting an image bearing member, and sealing members having edge portions for contacting side edges of the cleaning blade; and forming the side edges of the cleaning blade and/or the edge portions of the sealing members contacting the side edges of the cleaning blade at an angle, and contacting the side edges of the cleaning blade to the edge portions of the sealing members.

The invention in a yet further aspect pertains to a cleaning device, comprising: a cleaning blade for pressure-contacting the surface of an image bearing member; and a pair of elastic sealing members having edge portions for contacting two edges of the cleaning blade, wherein, when mounting said cleaning blade the two side edges of said cleaning blade are brought to be into contact with the edge portions of the elastic sealing members with increasing pressure in accordance with advancement of the cleaning blade toward a predetermined position.

BRIEF DESCRIPTION OF THE DRAWINGS

FIG. 3(*b*) is a sectional side view of the principal part shown in FIG. 3(*a*);

FIG. 4(*b*) is a sectional side view of the principal part shown in FIG. 4(*a*);

FIG. 5(*b*) is a sectional side view of the principal part shown in FIG. 5(*a*);

DETAILED DESCRIPTION OF THE PREFERRED EMBODIMENTS

A description will now be provided of a cleaning device to which the present invention is applied, a laser-beam printer which includes the cleaning device, and a method of assembling the cleaning device.

In the following explanation of the preferred embodiments of the present invention, a cleaning blade is provided in pressure contact with the surface of an image bearing member and a pair of elastic sealing members contact two side edges of the cleaning blade. In mounting the cleaning blade, the side edges of the cleaning blade contact the edges of the sealing members with increasing pressure in accordance with advancement of the cleaning blade toward a predetermined position.

According to such a configuration, it becomes possible to perform an excellent cleaning operation that is always stable while securely preventing leakage of toner particles from the two side edges of the cleaning blade.

Figure 1:
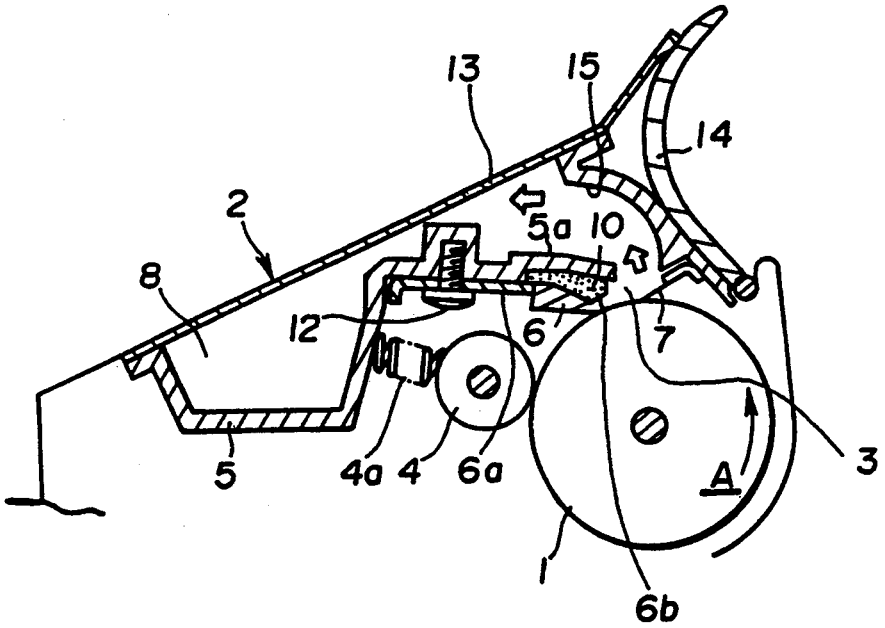
FIG. 1 is a sectional side view of a cleaning device according to an embodiment of the present invention.
Figure 2:
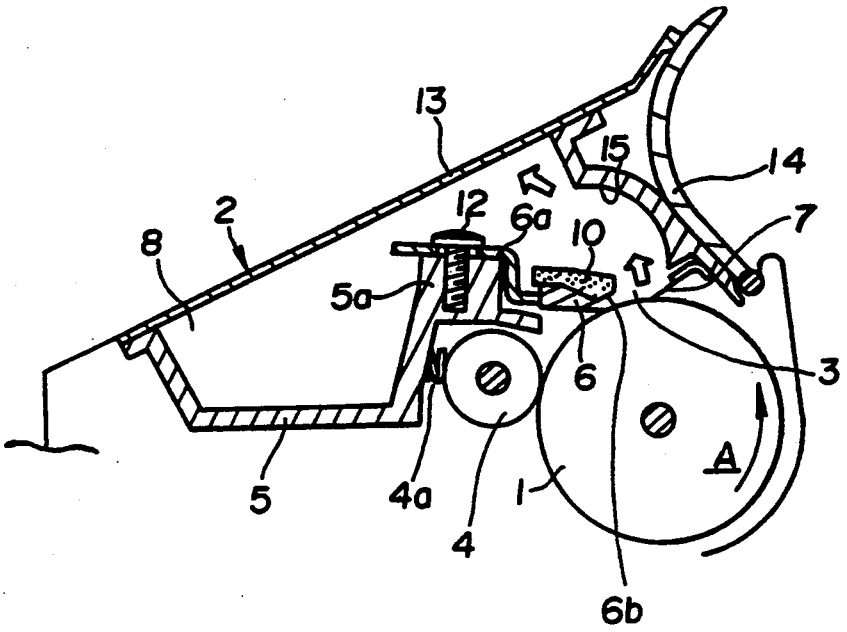
FIG. 2 is a sectional side view of a cleaning device according to another embodiment of the present invention.

FIGS. 1 and 2 are sectional side views of cleaning devices to which the present invention is applied. FIG. 1 illustrates an embodiment in which a cleaning blade 6 is screwed from below to a blade mounting unit 5*a* of a receptacle 5 of the cleaning device to a blade holder 6*a*. FIG. 2 illustrates another embodiment in which a cleaning blade 6 is screwed from above via a blade holder 6*a*.

As shown in FIGS. 1 and 2, a cleaning device 2 is disposed close to an image bearing member 1 (for example, an electrophotographic photosensitive drum or the like) having its axis perpendicular to the plane of FIGS. 1 and 2 and rotating in the direction of arrow A. The cleaning device 2 provides an opening 3 facing the surface of the image bearing member 1. A cleaning blade 6 extending in the longitudinal direction of the image bearing member 1, and a scooping sheet 7 provided at a position facing the cleaning blade 6 are disposed in the opening 3. The cleaning blade 6 is supported by the blade holder 6*a* which is mounted on the mounting member 5*a* of the receptacle 5 of the cleaning device 2, using screws 12.

As will be described later, when toner particles remaining on the surface of the image bearing member 1 reach the position of the cleaning device 2 after the completion of an image forming operation, the toner particles pass through the scooping sheet 7 and reach the position where the blade 6 contacts the surface of the image bearing member 1. The toner particles are removed from the surface of the image bearing member 1 by being scraped off by the blade 6. Subsequently, the removed toner particles are conveyed along a wall 15 of the receptacle 5 in the direction of the block arrows, and reach a toner reservoir 8 within the receptacle 5.

That is, the cleaning device 2 includes the receptacle 5 provided with the opening 3 at the side facing the photosensitive member 1, serving as the image bearing member. The receptacle 5 is disposed along the longitudinal direction of the photosensitive member 1. The elastic cleaning blade 6 is mounted on the receptacle 5 via the holder 6*a*. The cleaning blade 6 contacts the circumferential surface of the photosensitive member 1 so that the blade's edge 6*b* faces the direction of rotation of the photosensitive member 1 (the direction shown by arrow A), and removes toner particles remaining on the circumferential surface of the photosensitive member 1 after an image transfer operation by scraping off the particles from the circumferential surface of the photosensitive member 1. Examples of suitable materials for the cleaning blade include silicone, polyurethane, nitrile, a synthetic rubber (such as neoplane, perflon, or the like), a natural rubber, or the like. A suitable hardness for the material is 30°90° Japanese Industrial Standards (JIS). However, the material and the material's hardness are not limited to these examples, but may be appropriately selected. The scooping sheet 7 is disposed at a side upstream from the blade 6 in the direction of rotation of the photosensitive drum 1. One end of the scooping sheet 7 lightly contacts the surface of the photosensitive member 1 to remove the toner particles remaining on the surface of the photosensitive member 1, and guides the toner particles removed from the surface of the photosensitive member 1 by the blade 6 to a position separated from the surface of the photosensitive member 1, that is, within the receptacle 5. As for the scooping sheet 7, urethane, materials such as polyethylene terephthalate (PET), and the like may be used.

In the cleaning device 2 shown in FIGS. 1 and 2, sealing members 10 comprising an elastic material, such as a sponge, or the like, are mounted on the mounting member 5*a* at both end portions of the blade 6. A charging roller 4 is pressed against the surface of the image bearing member 1 by a spring 4*a*, and charges the image bearing member 1.

Figure 3A:
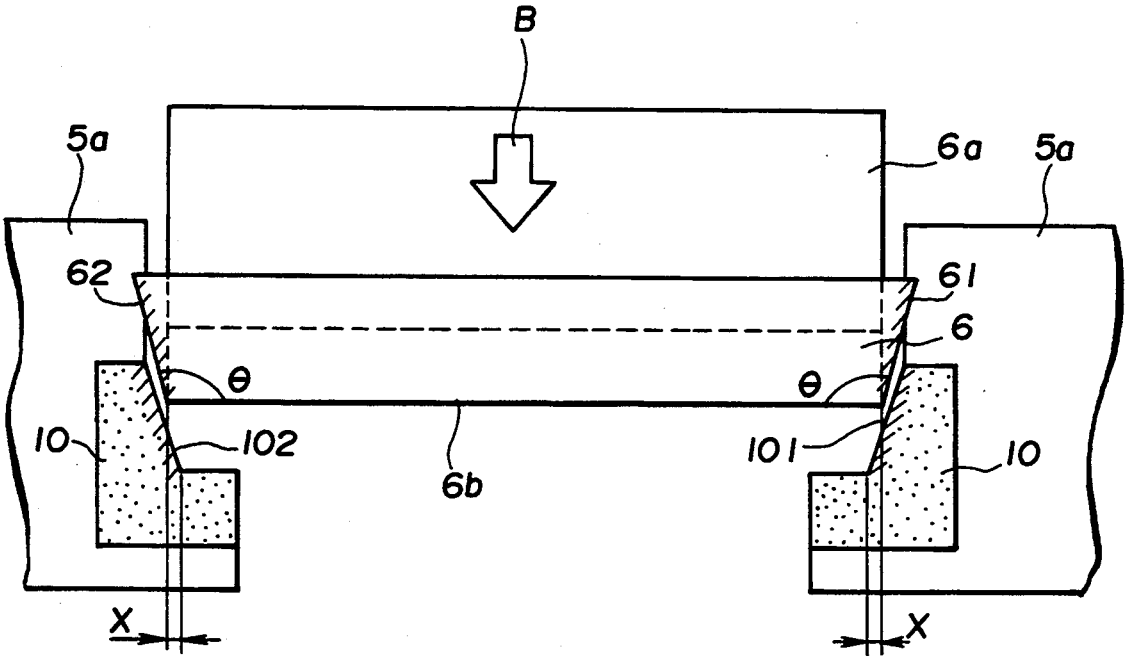
FIG. 3(*a*) is a plan view, as seen from above, of a principal part of the cleaning device shown in FIG. 1 or 2.
Figure 3B:
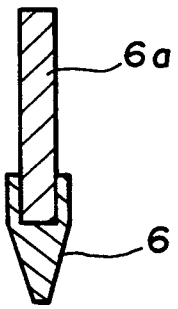

Next, a further explanation of the cleaning blade 6 and the surrounding components will be provided with reference to FIGS. 3(*a*) and 3(*b*).

FIGS. 3(*a*) and 3(*b*) illustrate a principal part of the embodiments shown in FIGS. 1 and 2, and show the cleaning blade 6, the mounting member 5*a* situated at both ends thereof, and the sealing members 10 mounted on the mounting member 5*a* of the cleaning device 2 shown in FIGS. 1 and 2 (of course, the invention is not limited to this arrangement).

The cleaning device 2 is assembled by advancing the cleaning blade 6 supported by the blade holder 6*a* in the direction of the block arrow B, and contacting two end portions of the cleaning blade 6 to the inner edges of the sealing members 10 mounted on the mounting member 5*a*. The blade 6 and the sealing members 10 are thereby mounted in a state of being in close contact with each other. As a result, a cleaning function is provided, and leakage of toner particles is prevented.

In the present embodiment, as shown in FIG. 3(*a*), tapered portions 61 and 62 are formed at both side edges of the cleaning blade 6 so that the width of the blade 6 becomes narrower in the mounting direction of the blade 6. Tapered portions 101 and 102 are also formed in the inner edges of the elastic sealing members 10 facing the cleaning blade 6 so as to be substantially parallel with the above-described tapered portions 61 and 62. Moltopren or the like may, for example, be used as the material used for the sealing members 10. The distance between the tapered portions 101 and 102 of the inner edges of the respective sealing members 10 in a natural state is generally smaller than the distance between the tapered portions 61 and 62 of the blade 6 at respective positions of the tapered portions 101 and 102 so that the two side edges of the blade 6 come into increasing pressure contact with the inner edges of the sealing members 10 when the cleaning blade 6 further advances from the position shown in FIG. 3(*a*) (that is, it moves downwardly in FIG. 3(*a*)) to a predetermined position. In other words, the sealing members 10 are attached to the mounting member 5*a* so that when the cleaning blade 6 is brought to the predetermined position, the tapered portions 61 and 62 of the blade 6 overlap with the tapered portions 101 and 102 of the sealing members 10 by an appropriate amount (the x shown in FIG. 3(*a*)). In the present embodiments, the overlapped amount x is preferably about 0.1–1 mm. However, the overlapped amount x is not limited to such values, but may be appropriately selected.

That is, in the present embodiment, the side edges 61 and 62 of the cleaning blade 6 and the edges 101 and 102 of the sealing members 10 are formed at an angle with respect to blade edge 6*b*. More specifically, the tapered edges are provided in the blade 6 so that the width of the blade 6 increases in the direction away from the blade edge 6*b* contacting the circumferential surface of the photosensitive drum 1. In the present embodiments, the side edges 61 and 62 of the blade 6 are angled so that the angle (represented by $\theta$ in FIG. 3(*a*)) made by each of the side edges 61 and 62 and the blade edge 6*b* is preferably between about 100 degrees and about 165 degrees, and more preferably between about 120 degrees and about 150 degrees. Thus, the blade 6 is brought into contact with the sealing members 10 so that the side edges 61 and 62 of the blade 6 contact the edges 101 and 102 of the sealing members 10 with increasing pressure.

By configuring and assembling the cleaning blade 6 and the sealing members 10 in the above-described manner, even if above-described errors are produced in processing and assembling the cleaning blade 6, the sealing members 10, and other components surrounding these components, it is possible to compensate for all of these errors, and to securely and sufficiently bring both side edges of the cleaning blade 6 and the sealing members 10 into pressure contact. Hence, it becomes possible to securely prevent leakage of toner particles.

Figure 4A:
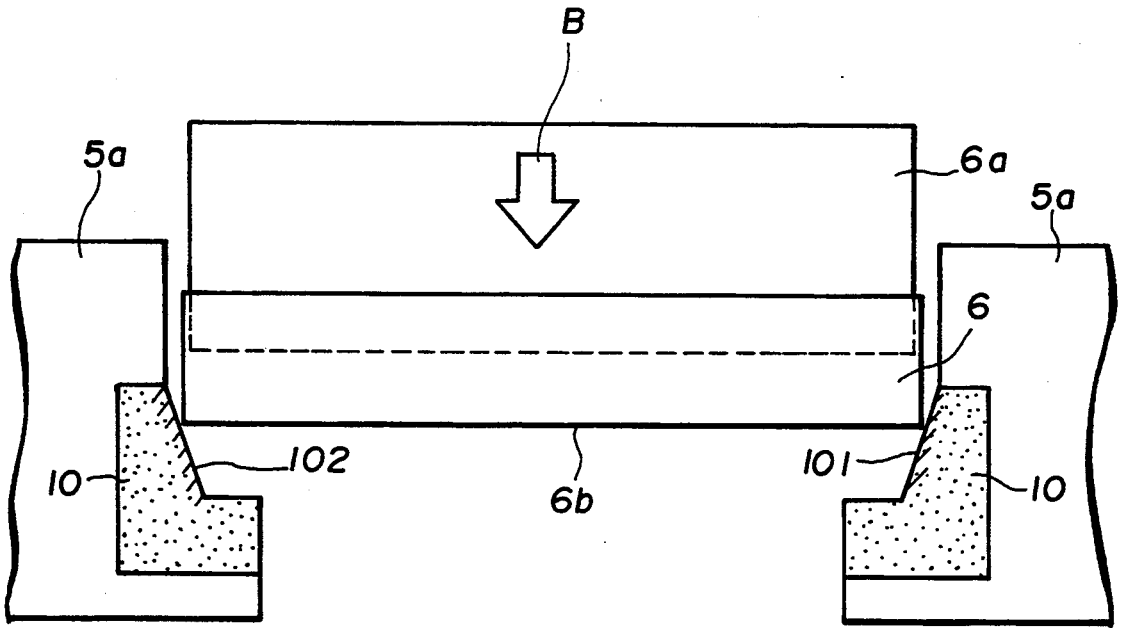
FIG. 4(*a*) is a plan view, as seen from above, of a principal part of a cleaning device according to still another embodiment of the present invention.
Figure 4B:
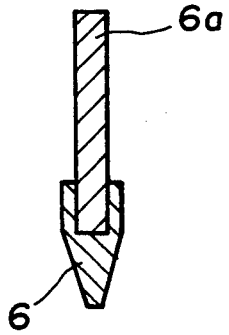
Figure 5:
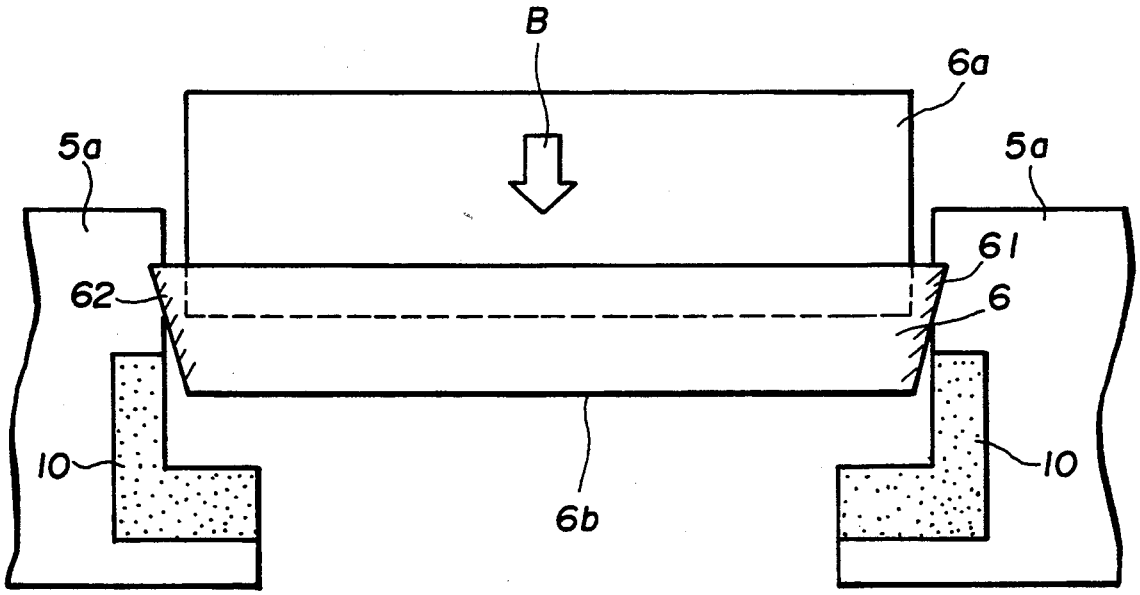
FIG. 5(*a*) is a plan view, as seen from above, of a principal part of a cleaning device according to still another embodiment of the present invention.
Figure 5:
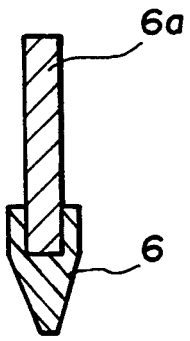

FIGS. 4(*a*) and 4(*b*) illustrate still another embodiment of the present invention. In the present embodiment, tapered portions are not formed at the ends of the cleaning blade 6, but rectangular sides are formed in the cleaning blade 6. Tapered portions are provided only in the sealing members 10. FIGS. 5(*a*) and 5(*b*) illustrate still another embodiment of the present invention. In the present embodiment, in contrast to the embodiment shown in FIGS. 4(*a*) and 4(*b*), tapered portions are formed only in the cleaning blade 6. Also in these embodiments, the same effect as in the embodiment shown in FIGS. 3(*a*) and 3(*b*) can be obtained by appropriately selecting the dimensions of the two side edges of the cleaning blade 6 and the inner edges of the sealing members 10.

Figure 6:
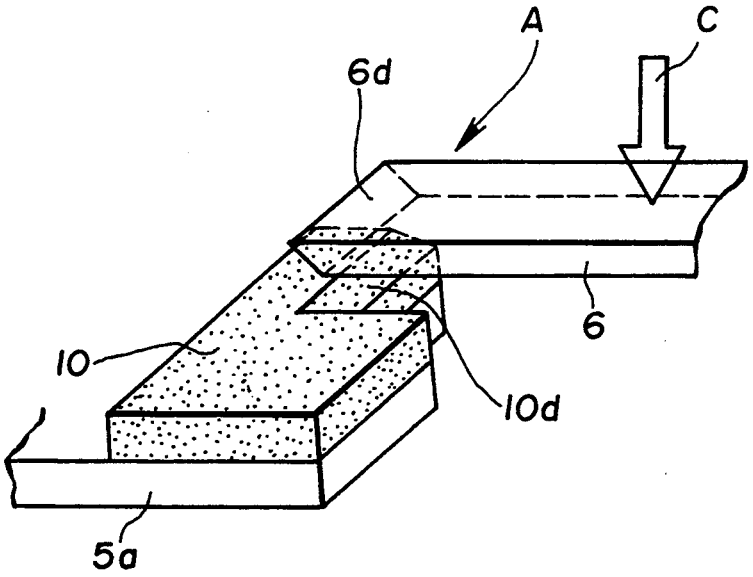
FIG. 6 is a perspective view of a blade and a sealing member according to still another embodiment of the present invention.
Figure 7:
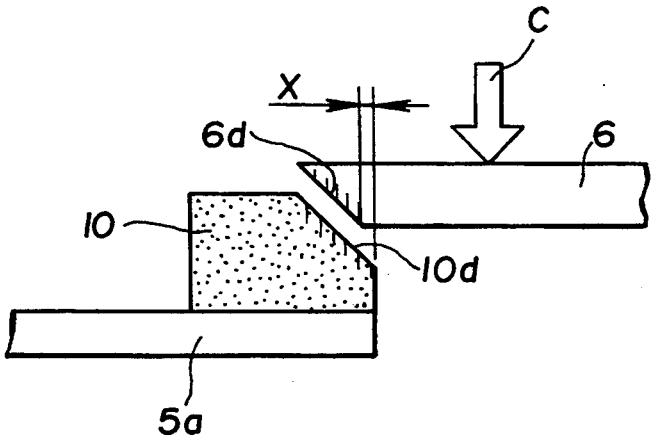
FIG. 7 is a side view of the blade and the sealing member shown in FIG. 6.

FIGS. 6 and 7 illustrate still another embodiment of the present invention. FIGS. 6 and 7 show only one of the sealing members 10 and the side edge of the cleaning blade 6 facing it.

In the present embodiment, as shown in FIGS. 6 and 7, tapered surfaces 6*d* and 10*d* are formed at each of the two side edges of the cleaning blade 6, and at the edge of each of the sealing members 10 facing it, respectively. An overlapping amount indicated by x in FIG. 7 is provided between the tapered surfaces 6*d* and 10*d*. In an assembling operation, the cleaning blade 6 reaches a predetermined position by being moved in the direction of arrow C. Also according to such a configuration, it is possible to securely prevent leakage of toner particles by pressing the edges 6*d* of the cleaning blade 6 against the edges 10*d* of the sealing members 10. In the present embodiment, the overlapped amount is preferably about 0.1–1 mm but is not limited to this range and may also be appropriately selected.

Figure 8:
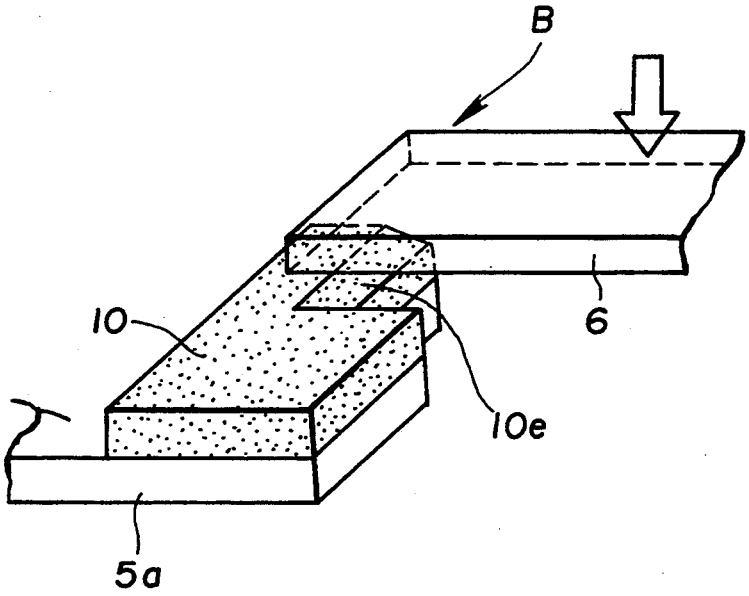
FIG. 8 is a perspective view of a blade and a sealing member according to still another embodiment of the present invention.
Figure 9:
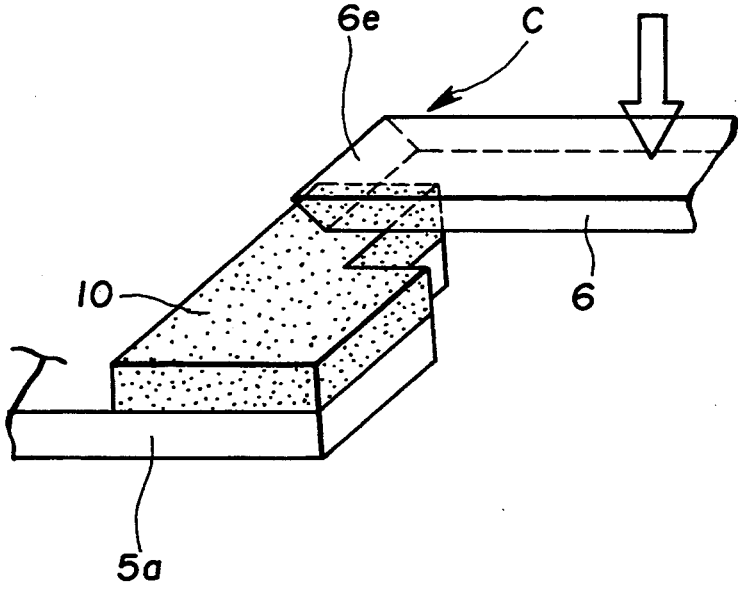
FIG. 9 is a perspective view of a blade and a sealing member according to still another embodiment of the present invention.

FIGS. 8 and 9 are perspective views of respective principal parts of still other embodiments of the present invention. In the case of the embodiment shown in FIG. 8, a tapered surface 10*e* is formed only in each of the edges of the sealing members 10. In the case of the embodiment shown in FIG. 9, a tapered surface 6*e* is formed only at each of the side edges of the blade 8. In the both cases, the other non-tapered surfaces are rectangular. Also according to such configurations, the same effect as in the embodiment shown in FIGS. 8 and 7 can be obtained.

Figure 10:
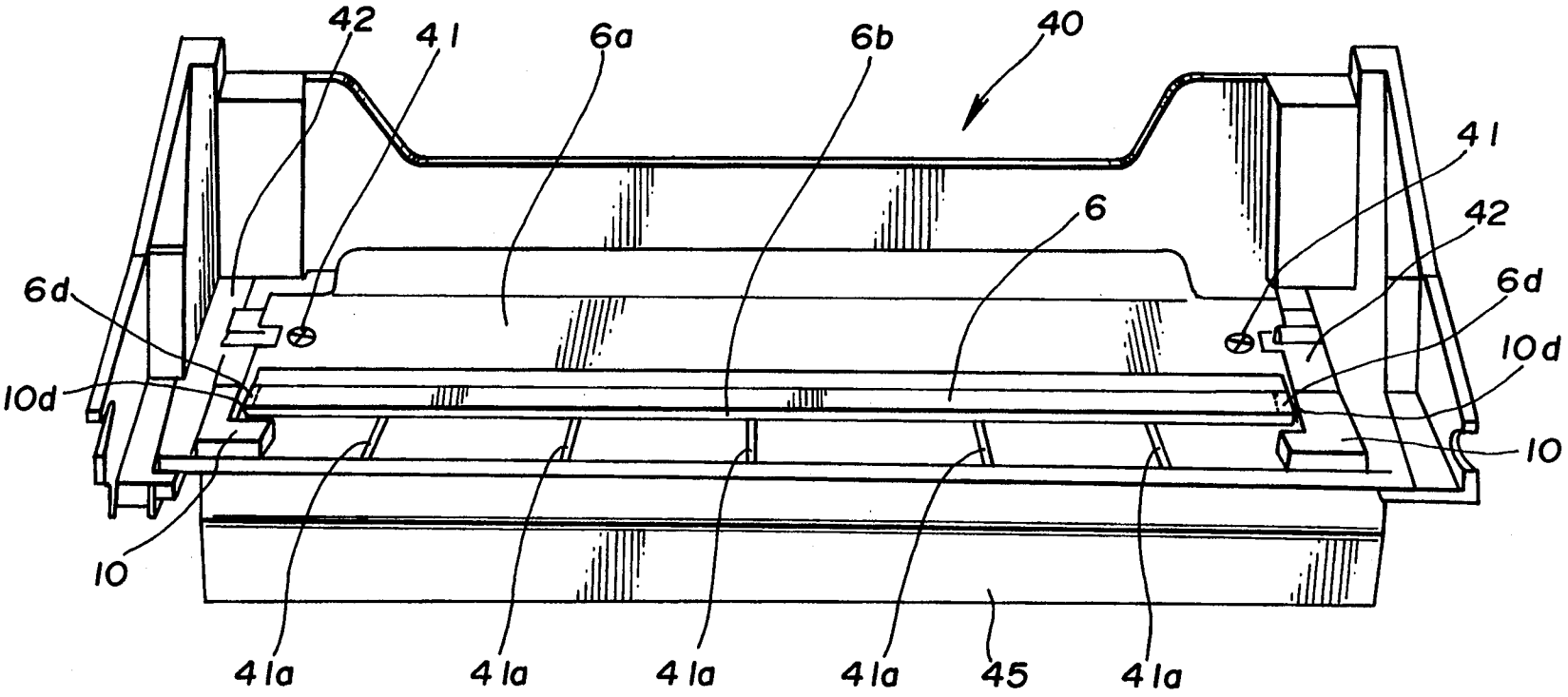
FIG. 10 is a perspective view of a cleaning device according to still another embodiment of the present invention.

Next, a description will be provided of the cleaning device of the embodiment shown in FIGS. 6 and 7 and a method of assembling the device with reference to FIG. 10.

In FIG. 10, reference numeral 40 represents the cleaning device, in which the cleaning blade 6 and the sealing members 10 shown in FIGS. 6 and 7 are provided. The blade holder 6*a* is fixed to a frame 42 of the device 40 by screws 41. The blade 6 may be formed integrally with the holder 6*a*, secured with fasteners to the holder 6*a*, or bonded to the holder 6*a*. The sealing members 10 are bonded to the frame 42 of the device 40 using a double-sided adhesive tape so that each of the edges 10*d* of the sealing members 10 contacts each of the side edges 6*d* of the blades 6 in an overlapped state. A removed-toner reservoir 45 for storing toner particles removed from the circumferential surface of the photosensitive drum 1 by the blade 6 is provided below the blade edge 6*b*. Parallel partition plates 41*a* are fixed within the removed-toner reservoir 45 so as to regulate the movement of stored toner particles.

Next, an explanation will be provided of a method of assembling the cleaning device 40.

First, the blade 6 and the blade holder 6*a* are integrally formed. However, the method of assembling these components is not limited to such a method. For example, the blade 6 may be bonded to the holder 6*a*, or mounted to the holder 6*a* using screws, or the like. Subsequently, the side edges of the blade 6 are cut so as to be tapered as described above. The blade 6 (the holder 6*a*) is then mounted to the frame 42 of the device 40 from right above the sealing members 10, which are bonded to the frame 42 of the device 40 so that the edges 10*d* face each other. At that time, as shown in FIGS. 6 and 7, the holder 6*a* reaches the predetermined mounting position where the side edges 6*d* of the blade 6 abut the edges 10*d* of the sealing members 10. Subsequently, the holder 6*a* is screwed to the frame 42 in a state in which the edges 10*d* of the sealing members 10 are in close contact with the side edges 6*d* of the blade 6, whereby the assembly operation is completed.

An explanation will now be provided of a laser-beam printer to which the above-described embodiments can be applied.

Figure 11:
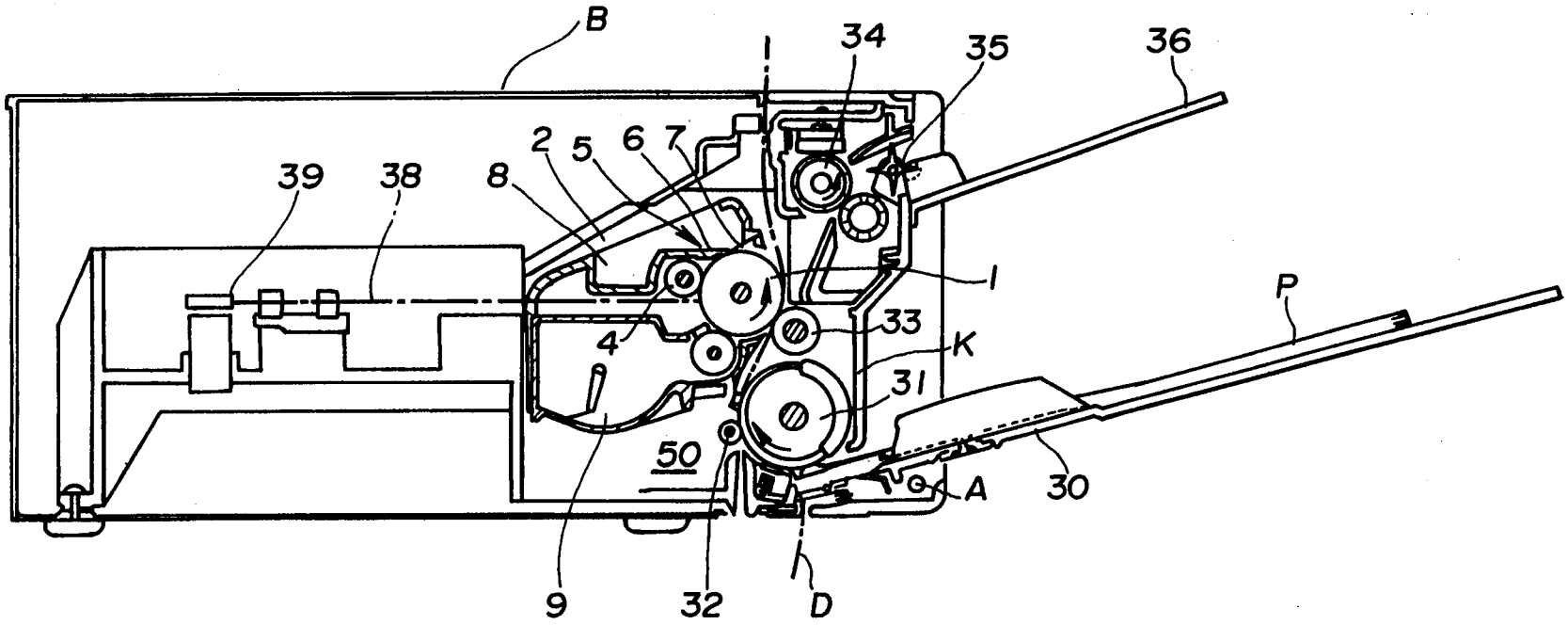
FIG. 11 is a sectional side view of a laser-beam printer according to still another embodiment of the present invention.

FIG. 11 is a vertical cross-sectional view of the laser-beam printer of the present invention. In the laser-beam printer, a plurality of cut sheets P are mounted in a paper-feeding tray 30, and each of the cut sheets P is conveyed to an image forming unit by a paper-feeding roller 31 and a conveying roller 32. An image is transferred onto the cut sheet P by a transfer roller 33, and the cut sheet P is guided to a fixing device 34, where the transferred image is fixed using a heating roller. Subsequently, the cut sheet P is discharged onto a paper-discharge tray 36 by a discharging roller 35.

An assembly comprising a paper-feeding unit including the paper-feeding tray 30 and the paper-feeding roller 31, a conveying unit including the conveying roller 32, a fixing unit including the fixing device 34, and a paper-discharging unit including the discharging roller 35 and the paper-discharge tray 36 is pivoted around a shaft A relative to a base B of the device. The division between these units is depicted by one-dot chain lines shown therebetween in FIG. 11, and are configured so as to be openable and closable.

The above-described image forming unit comprises a process cartridge 50 in which the photosensitive drum 1, the cleaning device 2, the charging roller 4 and the developing unit 9 are provided as one body. The charging roller 4 can charge the photosensitive drum 1 by applying an electric bias voltage to a semiconductive elastic member, such as a conductive rubber roller. A latent image is formed by projecting a laser beam 38 on the photosensitive drum 1 in accordance with image information. Reference numeral 39 represents a laser output device.

The cartridge 50 is replaced with a new cartridge after forming a predetermined amount of images in consideration of the life of the photosensitive drum, exhaustion of toner, and the like. The replacement is performed in the following way. That is, the apparatus is configured so that the cartridge 50 can be drawn to the side where an outer cover K containing the paper-feeding, conveying, fixing and paper-discharging units is opened when the outer cover K is opened. Hence, the operator can take out the cartridge 50 from the main body of the apparatus in a direction orthogonal to the direction of the generatrix of the photosensitive drum 1. The new cartridge 50 is mounted in the main body of the apparatus by performing the reverse operation to the above-described removal operation. By closing the outer cover K after mounting the cartridge 50, the cartridge 50 is securely set at a predetermined position by being pressed by the transfer roller 33.

Although in the above-described laser-beam printer a case of using the process cartridge has been described, the present invention is not limited to such a case. In the case in which the cleaning device is provided in the process cartridge, the process cartridge comprises an electrophotographic photosensitive member, serving as an image bearing member, and cleaning means provided as one body so as to be detachable relative to the main body of an image forming apparatus. The process cartridge may further comprise, for example, charging means, developing means, and the like.

According to the above-described embodiments, it is possible to provide a cleaning device which comprises a cleaning blade, and in which leakage of toner particles from edge portions of the blade is prevented by contacting elastic sealing members to both side edges of the blade. Since the device is configured so that both side edges of the cleaning blade are in pressure contact with the sealing members facing the blade when the cleaning blade is disposed at a predetermined position, it is possible to easily and effectively compensate for processing errors, assembling errors, and the like, of the components provided in the sealing portion, and to securely prevent leakage of toner particles from the side edges of the blade. It becomes thereby possible to obtain a high-quality image by greatly reducing the possibility of occurrence of failure in a cleaning operation.

As described above, according to the present invention, it becomes possible to provide a cleaning device which securely prevents leakage of toner particles by compensating for processing errors and assembling errors, an image forming apparatus which includes the cleaning device, and a method of assembling the cleaning device.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cleaning device for removing toner particles remaining on an image bearing member, said cleaning device comprising:

a cleaning blade for contacting the image bearing member; and a plurality of sealing members having edge portions contacting side edges of said cleaning blade, wherein at least one of (i) the side edges of said cleaning blade, and (ii) the edge portions of said plurality of sealing members contacting the side edges of said cleaning blade, are tapered.

2. A cleaning device according to claim 1, wherein when said cleaning blade is brought into contact with said plurality of sealing members, the side edges of said cleaning blade contact the edge portions of said plurality of sealing members with increasing pressure.

3. A cleaning device according to claim 1, wherein the side edges of said cleaning blade comprise tapered edges formed in said cleaning blade such that a width of said cleaning blade increases in a direction away from a portion of said cleaning blade contacting the image bearing member.

4. A cleaning device according to claim 1, wherein said cleaning blade is formed such that an angle between at least one of the side edges of said cleaning blade and a portion of said cleaning blade contacting the image bearing member is between about 100 degrees and about 165 degrees.

5. A cleaning device according to claim 1, wherein said cleaning blade comprises an elastic material.

6. A cleaning device according to claim 1, wherein said plurality of sealing members comprise an elastic material.

7. A cleaning blade according to claim 1, further comprising an accommodating receptacle for accommodating toner particles removed from the image bearing member by said cleaning blade.

8. A cleaning device according to claim 1, further comprising a scooping sheet for guiding toner particles removed from the image bearing member in a direction away from the image bearing member.

9. A cleaning device according to claim 1, wherein said cleaning device is provided in a process cartridge as one body, said process cartridge comprising said cleaning device and the image bearing member, and said process cartridge being detachable relative to a main body of an image forming apparatus.

10. An image forming apparatus for forming an image on a recording medium, said image forming apparatus comprising:

an image bearing member;

cleaning means comprising a cleaning blade for contacting said image bearing member, and a plurality of sealing members having edge portions contacting side edges of said cleaning blade, at least one of (i) the side edges of said cleaning blade, and (ii) the edge portions of said plurality of sealing members contacting the side edges of said cleaning blade, being tapered; and conveying means for conveying the recording medium.

11. An image forming apparatus according to claim 10, wherein said image forming apparatus comprises an electrophotographic copier.

12. An image forming apparatus according to claim 10, wherein said image forming apparatus comprises a laser-beam printer.

13. An image forming apparatus according to claim 10, wherein said image forming apparatus comprises a facsimile apparatus.

14. An image forming apparatus according to claim 10, wherein at least said cleaning means and said image bearing member are integrally formed as a cartridge, said cartridge being detachable relative to a main body of said image forming apparatus.

15. A method of assembling a cleaning device for removing toner particles remaining on an image bearing member, said method comprising the steps of:

providing each of (i) a cleaning blade for contacting an image bearing member, and (ii) sealing members having edge portions contacting side edges of the cleaning blade;

forming, at a non-zero angle relative to a surface being perpendicular to a generatrix of said image bearing member, at least one of (i) the side edges of the cleaning blade, and (ii) the edge portions of the sealing members; and contacting the side edges of the cleaning blade to the edge portions of the sealing members.

16. A method of assembling a cleaning device for removing toner particles remaining on an image bearing member, said method comprising the steps of:

providing each of (i) a cleaning blade for contacting an image bearing member, and (ii) sealing members having edge portions contacting side edges of the cleaning blade;

forming at least one of (i) the side edges of the cleaning blade, and (ii) the edge portions of the sealing members, at an angle, and contacting the side edges of the cleaning blade to the edge portions of the sealing members; and bringing the cleaning blade into contact with the sealing members such that the side edges of the cleaning blade contact the edge portions of the sealing members with increasing pressure.

17. A cleaning device, comprising:

a cleaning blade for pressure-contacting a surface of an image bearing member; and a pair of elastic sealing members having edge portions contacting two side edges of said cleaning blade, wherein, when mounting said cleaning blade, the two side edges of said cleaning blade contact the edge portions of said pair of elastic sealing members with increasing pressure in accordance with advancement of said cleaning blade toward a predetermined position.

18. A cleaning device according to claim 17, further comprising pressing means for pressing the two side edges of said cleaning blade against said pair of elastic sealing members at a predetermined mounting position, said pressing means comprising tapered edges formed in the two side edges of said cleaning blade such that a width of said cleaning blade is reduced toward a portion of said cleaning blade which pressure-contacts the surface of the image bearing member.

19. A cleaning device according to claim 17, further comprising pressing means for pressing the two side edges of said cleaning blade against said pair of elastic sealing members at a predetermined mounting position, said pressing means comprising tapered edges formed in the edge portions of said pair of elastic sealing members such that a space between said pair of elastic sealing members tapers inwardly in a direction approaching the predetermined mounting position of said cleaning blade.

20. A cleaning device according to claim 1, wherein said cleaning blade is formed such that an angle between at least one of the side edges of said cleaning blade and a portion of said cleaning blade contacting the image bearing member is between about 120 degrees and about 150 degrees.

* * * * *

UNITED STATES PATENT AND TRADEMARK OFFICE

CERTIFICATE OF CORRECTION

PATENT NO. : 5,404,216

DATED : April 4, 1995

INVENTOR(S) : Atsushi NUMAGAMI, et al.

It is certified that error appears in the above-indentified patent and that said Letters Patent is hereby corrected as shown below:

COLUMN 2:

Line 46, "to be" should be deleted.

COLUMN 4:

Line 27, "30°90°" should read --30°-90°--.

COLUMN 6:

Line 31, "blade 8." should read --blade 6.--

COLUMN 9:

Line 4, "blade" should read --device--.

Signed and Sealed this

Second Day of April, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,404,216

DATED : April 4, 1995

INVENTOR(S) : Atsushi NUMAGAMI, et al.

It is certified that error appears in the above-indentified patent and that said Letters Patent is hereby corrected as shown below:

Title page:

ITEM [73]:

Assignee, "Csnon Kabushiki Kaisha" should read --Canon Kabushiki Kaisha--.

Signed and Sealed this

Thirtieth Day of July, 1996

Bruce Lehman

*Attest:*

BRUCE LEHMAN

*Attesting Officer*

*Commissioner of Patents and Trademarks*